US006689734B2

(12) United States Patent
Doyel et al.

(10) Patent No.: US 6,689,734 B2
(45) Date of Patent: Feb. 10, 2004

(54) LOW OZONE DEPLETING BROMINATED COMPOUND MIXTURES FOR USE IN SOLVENT AND CLEANING APPLICATIONS

(75) Inventors: Kyle J. Doyel, Franklin, TN (US); Michael L. Bixenman, Old Hickory, TN (US); Scotty S. Sengsavang, Murfreesboro, TN (US); Arthur J. Thompson, Madison, TN (US); Valerie G. Porter, Antioch, TN (US); Patricia D. Overstreet, Murfreesboro, TN (US); Kristie L. Gholson, Murfreesboro, TN (US)

(73) Assignee: Kyzen Corporation, Nashville, TN (US)

( * ) Notice: Subject to any disclaimer, the term of this patent is extended or adjusted under 35 U.S.C. 154(b) by 0 days.

(21) Appl. No.: 10/191,280

(22) Filed: Jul. 10, 2002

(65) Prior Publication Data

US 2003/0083220 A1 May 1, 2003

Related U.S. Application Data

(62) Division of application No. 08/903,002, filed on Jul. 30, 1997, now abandoned.

(51) Int. Cl.[7] ..... C11D 3/44

(52) U.S. Cl. ..... 510/410; 510/177; 510/365; 510/407; 510/411; 510/412; 510/505; 510/506; 134/38; 134/40

(58) Field of Search ..... 510/407, 411, 510/412, 506, 177, 505, 365; 134/40, 38

(56) References Cited

U.S. PATENT DOCUMENTS

| | | | | |
|---|---|---|---|---|
| 4,056,403 A | * | 11/1977 | Cramer et al. | 252/69 |
| 5,023,010 A | | 6/1991 | Merchant | 252/69 |
| 5,059,728 A | | 10/1991 | Li et al. | 570/134 |
| 5,064,559 A | | 11/1991 | Merchant et al. | 252/67 |
| 5,064,560 A | | 11/1991 | Merchant | 252/67 |
| 5,073,206 A | | 12/1991 | Wilson et al. | 134/40 |
| 5,085,796 A | | 2/1992 | Stachura et al. | 510/409 |
| 5,085,797 A | | 2/1992 | Swan et al. | 510/408 |
| 5,085,798 A | | 2/1992 | Swan et al. | 510/408 |
| 5,100,572 A | | 3/1992 | Merchant | 252/67 |
| 5,106,526 A | | 4/1992 | Magid et al. | 510/409 |
| 5,116,525 A | | 5/1992 | Merchant | 252/67 |
| 5,116,526 A | | 5/1992 | Magid et al. | 510/409 |
| 5,118,437 A | | 6/1992 | Magid et al. | 510/258 |
| 5,120,461 A | | 6/1992 | Logsdon et al. | 510/411 |
| 5,120,462 A | | 6/1992 | Buchwald et al. | 510/177 |
| 5,122,294 A | | 6/1992 | Logsdon et al. | 510/411 |
| 5,124,063 A | | 6/1992 | Logsdon et al. | 510/258 |
| 5,124,064 A | | 6/1992 | Logsdon et al. | 510/258 |
| 5,124,065 A | | 6/1992 | Magid et al. | 510/193 |
| 5,126,067 A | | 6/1992 | Swan et al. | 510/408 |
| 5,137,651 A | | 8/1992 | Stachura et al. | 510/255 |
| 5,145,598 A | | 9/1992 | Swan et al. | 510/409 |
| 5,190,685 A | | 3/1993 | Logsdon et al. | 510/255 |
| 5,194,170 A | | 3/1993 | Merchant et al. | 252/67 |
| 5,196,137 A | | 3/1993 | Merchant | 252/67 |
| 5,219,488 A | | 6/1993 | Basu et al. | |
| 5,219,489 A | | 6/1993 | Swan et al. | 510/409 |
| 5,219,490 A | | 6/1993 | Basu et al. | 510/258 |
| 5,221,493 A | | 6/1993 | Merchant et al. | 252/67 |
| 5,225,099 A | | 7/1993 | Basu et al. | |
| 5,250,208 A | | 10/1993 | Merchant et al. | 252/67 |
| 5,288,422 A | | 2/1994 | Basu et al. | 510/408 |
| 5,290,473 A | | 3/1994 | Basu et al. | 510/409 |
| 5,320,683 A | | 6/1994 | Samejima et al. | 134/40 |
| 5,492,645 A | | 2/1996 | Oshima et al. | 510/412 |
| 5,531,916 A | | 7/1996 | Merchant | 510/412 |
| 5,558,810 A | | 9/1996 | Minor et al. | 252/67 |
| 5,607,912 A | * | 3/1997 | Samejima et al. | |
| 5,616,549 A | | 4/1997 | Clark | 510/412 |
| 5,665,170 A | * | 9/1997 | Lee et al. | |
| 5,792,277 A | * | 8/1998 | Shublin et al. | |
| 5,889,286 A | * | 3/1999 | Barthelemy et al. | |

FOREIGN PATENT DOCUMENTS

| | | | |
|---|---|---|---|
| JP | 02204449 | * | 8/1990 |
| JP | 02204455 | * | 8/1990 |
| JP | 7-197092 | | 8/1995 |
| JP | 7-292393 | * | 11/1995 |
| WO | WO 9506693 | | 3/1995 |
| WO | 95/06693 | | 3/1995 |
| WO | 96/22356 | | 7/1996 |
| WO | WO 9622356 | | 7/1996 |

OTHER PUBLICATIONS

Wisniak et al, "Vapor–liquid equilibria at 760 mmHg in the system methanol–2–propanol–propyl bromide and its binaries", J. Chem. Eng. Data, 30, 339–244. 1985.*

Fedorova et al, "Vapor–liquid phase equilibrium in a isopropyl alcohol–propyl bromide system at atmospheric pressure". 1987.*

Wisniak, et al., "Vapor–liquid equilibria at 760 mmHg in the system methanol–2–propanol–propyl bromide and its binaries" J. Chem. Eng. Data, 30, 339–244.

Fedorova, et al., "Vapor–liquid phase equilibrium in a isopropyl alcohol–propyl bromide system at atospheric pressure".

* cited by examiner

*Primary Examiner*—Gregory Webb
(74) *Attorney, Agent, or Firm*—Crowell & Moring LLP

(57) ABSTRACT

Chemical solvating, degreasing, stripping and cleaning agents. The agents are cleaning and solvating mixtures of mono brominated compounds with highly fluorinated compounds and/or other agents that improve and enhance the properties of the original mixture. The addition of these agents to the composition will modify the physical and/or cleaning characteristics of the monobrominated compound and/or monobrominated compound-fluorinated compound mixture to accomplish is desired cleaning or solvating task. These other agents are one or more of the following materials: alcohols, esters, ethers, cyclic ethers, ketones, alkanes, terpenes, dibasic esters, glycol ethers, pyrollidones, or low or non ozone depleting chlorinated and chlorinated/fluorinated hydrocarbons. These mixtures are useful in a variety of solvating, vapor degreasing, photoresist stripping, adhesive removal, aerosol, cold cleaning, and solvent cleaning applications including defluxing, drycleaning, degreasing, particle removal, metal and textile cleaning.

14 Claims, No Drawings

LOW OZONE DEPLETING BROMINATED COMPOUND MIXTURES FOR USE IN SOLVENT AND CLEANING APPLICATIONS

This application is a division of application Ser. No. 08/903,002, filed Jul. 30, 1997 now abandoned.

BACKGROUND OF THE INVENTION

The present invention concerns chemical solvating, degreasing, stripping and cleaning agents. More particularly, this invention relates to cleaning and solvating mixtures of mono brominated compounds with highly fluorinated compounds and/or other agents that improve and enhance the properties of the original mixture.

The present invention was made in response to concerns with ozone depleting materials, and toxicity concerns with non ozone depleting chlorinated materials. In September 1987, the United States and 22 other countries signed the Montreal Protocol on Substances that Deplete the Ozone Layer (the "Protocol"). The Protocol called for a freeze in the production and consumption of ozone depleting chemicals ("ODP's" or "ODC's") by the year 2000 for developed countries and 2010 for developing countries. In 1990 the United States enacted the Clean Air act mandating that the use of ozone depleting chemicals be phased out by the year 2000. In September 1991, the U.S. Environmental Protection Agency announced that ozone layer depletion over North America was greater than expected. In response to this announcement, President George Bush issued an executive order accelerating the phase-out of the production of ozone depleting materials to Dec. 31, 1995. More than 90 nations, representing well over 90% of the world's consumption of ODP's, have now agreed to accelerate the phase-out of production of high ozone depleting materials to Dec. 31, 1995 for developed countries and Dec. 31, 2005 for developing countries pursuant to the protocol.

Historically fluorine and chlorine based solvents were widely used for degreasing, solvating, solvent cleaning, aerosol cleaning, stripping, drying, cold cleaning, and vapor degreasing applications. In the most basic form the cleaning process required contacting a workpiece with the solvent to remove an undesired material, soil or contaminant. In solvating applications these materials were added to dissolve materials in such applications as adhesive or paint formulations.

Cold cleaning, aerosol cleaning, stripping and basic degreasing were simple applications where a number of solvents were used. In most of these processes the soiled item was immersed in the fluid, sprayed with the fluid, or wiped with cloths or similar objects that had been soaked with the fluid. The soil was removed and the item was allowed to air dry.

Drying, vapor degreasing and/or solvent cleaning consisted of exposing a room temperature workpiece to the vapors of a boiling fluid. Vapors condensing on the workpiece provided a clean distilled fluid to wash away soils and contaminants. Evaporation of the fluid from the workpiece provided a clean item similar to cleaning the same in uncontaminated fluid.

More difficult cleaning of difficult soils or stripping of siccative coatings such as photomasks and coatings required enhancing the cleaning process through the use of elevated fluid temperatures along with mechanical energy provided by pressure sprays, ultrasonic energy and or mechanical agitation of the fluid. In addition these process enhancements were also used to accelerate the cleaning process for less difficult soils, but were required for rapid cleaning of large volumes of workpieces. In these applications the use of immersion into one or more boiling sumps, combined with the use of the above mentioned process enhancements was used to remove the bulk of the contaminant. This was followed by immersion of the workpiece into a sump that contained freshly distilled fluid, then followed by exposing the workpiece to fluid vapors which condensed on the workpiece providing a final cleaning and rinsing. The workpiece was removed and the fluid evaporated. Vapor degreasers suitable in the above-described process are well known in art.

In recent years the art was continually seeking new fluorocarbon based mixtures which offered similar cleaning characteristics to the chlorinated and CFC based mixtures and azeotropes. In the early 1990's materials based on the compounds of HCFC began to appear. Three molecules in particular 1,1-dichloro-1-fluoro ethane (HCFC-141b), dichloro trifluoro ethane (HCFC-123), and dichloro pentafluoro propane (HCFC-225) were proposed as replacements for methyl chloroform and CFC blends. As more highly fluorinated materials these materials were less ozone depleting than current ODP's however these materials were weaker solvents and in order to properly clean required the use of co-solvents through the use of blends and azeotropes. Later toxicity studies performed on these materials, however, showed them to have unacceptable character for broad commercial use in cleaning applications. Consequently HCFC-123 was immediately limited in cleaning use, however new toxicity data may allow use in cleaning uses, and HCFC-141b was scheduled for phase out in the U.S. by Apr. 1, 1997. HCFC-225 is still used, however the material is scheduled for phase out by the Clean Air Act after the year 2000. Toxicity concerns with HCFC-225 are a concern to many users and the recommended commercial exposure level of blends of the various isomers of the material is 50 ppm.

The art in the mid 1990's changed as aqueous and semi-aqueous materials became the major choice of replacement for ODP's. The shift to these materials however had two drawbacks for some users. First was the requirement for new cleaning apparatus and machinery capable of handling and drying water. The second was the fact that certain niche applications in the marketplace could not tolerate the use of water in the cleaning process due to damage to the workpiece. This damage was caused by either incompatibility of water with the workpiece, or residual water remaining on the workpiece due to the geometry of the workpiece. This second factor resulted in the art shifting to processes cleaning with solvents and either rinsing with volatile flammable solvents such as acetone and isopropanol, or rinsing with highly fluorinated materials called perfluorocarbons (PFC's).

These PFC rinsing agents were investigated by some users. Other solvents such as low molecular weight alcohols, ketones and alkanes, were also evaluated since they provided users with acceptable rinsing and cleaning, however they were flammable and concerns were raised about their use in production applications. Systems that operated with these inexpensive solvents were very expensive and required explosion-proof machinery and buildings. Perfluorocarbons were deemed to be viable replacements in that they could potentially be operated in inexpensive vapor degreasing equipment such as was used for CFC's. Additionally these materials were inert, inflammable, and had very low toxicity. However, being inert these materials had no solvency, i.e., they did not dissolve the soils they were meant to remove from the workpieces, and were found to be poor cleaning materials. Other perceived drawbacks with these rinsing agents were that they were extremely expensive and required the use of modified vapor degreasers. Later work conducted by the U.S. EPA deemed PFC's to be unacceptable materials due to the fact that they had huge global warming potentials and would remain in the environment for thousands of years.

The art then evolved today to seeking materials for these specialty applications that required PFC like materials that had lower global warming potentials. Highly fluorinated materials such as hydrofluorocarbons (HFC's) and hydrofluoroethers (HFE's) and other highly fluorinated compounds are the result of the most recent disclosures. Like PFC, HFC's and HFE's exhibit the same characteristics, with the exception they are slightly less expensive than PFC's but are still orders of magnitude more expensive than CFC's and chlorinated solvents. Primarily used as rinsing, drying and inerting agents these materials exhibit poor solvency for the soils commonly encountered in most cleaning applications, and will require the use of solvent blends, co-solvent systems, and azeotrope like blends in order to effectively clean.

As a replacement for CFC compounds and mixtures in cleaning applications, the use of brominated materials has been suggested. Brominated compounds have many uses, one of which is as a flame retardant. Brominated compounds for many years have been used in the matrix of polymers where they retard the flammability of polymers and plastics. Brominated and fluorinated hydrocarbon compounds (bromo-fluorocarbons) form a class of compounds known as Halons, which were also used by themselves as fire fighting agents. These materials were extremely effective in extinguishing fires in areas which had expensive equipment and/or contained materials that were damaged by the use of water or other extinguishing agents. The halon materials were widely used on board ships and in computer rooms. Unfortunately, the combination of bromine and fluorine on a molecule was found to have a much greater impact on depleting ozone in the upper atmosphere than chlorine and fluorine. As a result these materials are scheduled for phase-out like the CFC's.

Monobrominated compounds however, are a class of chemicals that have not been as widely used as monochlorinated or multibrominated materials. Monobrominated hydrocarbons are not used as flame retardants since all of them are known to exhibit flash points, and therefore can burn given the right conditions. Monobrominated methane is probably the most abundant of the monobrominated compounds and is used widely as a fumigant in agriculture. $C_2$ to $C_{10}$ monobrominated materials for the most part have been used as chemical intermediates, and solvents in chemical processes. These materials have generally not been used in cleaning or degreasing applications due to flammability and stability concerns. Monobrominated compounds do exhibit some ozone depletion potential, although that ODP decreases with increasing carbon chain length. The only monobrominated compound that is currently under scrutiny for ozone depletion is methyl bromide, which is scheduled for phase out. Monobrominated compounds $C_2$ and greater all exhibit a negligible ozone depletion potential.

Recently a few cleaning and solvent applications using monobrominated hydrocarbons have been disclosed, mainly in Japan. A deterging solvent consisting of monobrominated propane with ethylene based glycol ethers and nitroalkanes as stabilizers is known. In addition the mixture can also have an assistant stabilizer consisting of chlorinated hydrocarbons, epoxides, amino alcohols, acetylene alcohols and triazoles. A deterging composition of monobrominated propane with alkyl ethylene based glycol ethers, nitroalkanes and 1,4 dioxane or trioxane is also known. Mixtures of petroleum based solvent and brominated compounds (isobromopropane) in certain ratios as cleaning agents for drycleaning are known as are halogenated solvents $C_1$ to $C_4$ that have a boiling point <100° C. and a flash point >11° C. plus a rust inhibitor for cleaning fluxes. Finally, a mixture of n-propyl bromide, terpenes and low boiling solvents is known for use in cleaning in vapor degreasers.

The brominated hydrocarbon mixtures all have flash points when tested on open cup type flash point testing machines, and although many of the prior art compositions were described as non-flammable, many of them will combust and/or propagate a flame in open air. Prior art descriptions of no flash point are correct but many of the citations refer to closed cup flash point methods which comply with DOT regulations for shipping of products in closed containers and/or drums. However in commercial practice closed cup flash points are not relevant since the described mixtures are used in open vapor degreasers, tanks, baths, or are used in sprays, wipes or other cleaning methods that are open to the air.

In addition, no indications were made in the prior art as to azeotrope-like behavior of the mixtures. Mixtures that exhibit the non-azeotrope and flash point character are less desirable, and are limited in actual use since they will not effectively operate for extended periods of time in vapor degreasing machines. Azeotrope-like behavior is desirable in vapor degreasing and in most applications since the cleaning/solvent mixture will remain constant and can be redistilled and reused, or used in final rinse cleaning.

SUMMARY OF THE INVENTION

It is a primary object of the present invention to provide a solvent mixture which can be used in solvating, vapor degreasing, photoresist stripping, adhesive removal, aerosol, cold cleaning, and solvent cleaning applications including defluxing, drycleaning, degreasing, particle removal, metal and textile cleaning and which is free of the aforementioned and other such disadvantages.

It is another object of the present invention to provide a solvent mixture of the type described which is a suitable replacement for ozone-depleting solvents.

It is still another object of the present invention to provide a solvent mixture of the type described which is a suitable replacement for toxic solvents.

It is yet another object of the present invention to provide a solvent mixture of the type described which is a suitable replacement for solvents with low flash points.

The present invention provides a solvent mixture which can be used in solvating, vapor degreasing, photoresist stripping, adhesive removal, aerosol, cold cleaning, and solvent cleaning applications including defluxing, drycleaning, degreasing, particle removal, metal and textile cleaning. The soils and contaminants that are removed in the present invention but are not limited to are oil, grease, coatings, flux, resins, waxes, rosin, adhesives, dirt, fingerprints, epoxies, polymers, and other common contaminants found in the art.

The present cleaning and solvating mixtures comprise mono brominated compounds with highly fluorinated compounds and/or other enhancement agents that improve and enhance the properties of the original mixture. The addition of these agents to the composition will modify the physical and/or cleaning characteristics of the monobrominated compound and/or monobrominated compound-fluorinated compound mixture to accomplish its desired cleaning or solvating task. The enhancement agents are one or more of the following materials: alcohols, esters, ethers, cyclic ethers, ketones, alkanes, terpenes, dibasic esters, glycol ethers, pyrollidones, or low or non ozone depleting chlorinated and chlorinated/fluorinated hydrocarbons. These mixtures are useful in a variety of solvating, vapor degreasing, photoresist stripping, adhesive removal, aerosol, cold cleaning, and solvent cleaning applications including defluxing, dry cleaning, degreasing, particle removal, metal and textile cleaning. In particular, the mono brominated compounds with highly fluorinated compounds and/or other enhancement agents can be used to replace highly ozone depleting materials such as chlorofluorocarbons (CFC), methyl chloroform, hydrochlorofluorocarbons (HCFC) or chlorinated solvents.

In the novel cleaning compositions of the present invention, monobrominated compounds of the formula $C_xH_{2x+1}Br$ where x is 2–12 and $C_yH_{2y-1}Br$ where y is 2–12 can be used. Fluorinated compounds of the formula $C_aF_bH_cX_d$ where a is 1–16, b>c, c can be 1–16, d can be 0 or greater and X can be O, N, halogen, or Si, in any possible combination as long as the number of F atoms exceeds the number of H atoms in the molecule, can be used. Throughout this specification and claims, by "halogen" is meant Cl, Br, and I. Other materials that can be added are one or more of the following materials: alcohols, esters, ethers, cyclic ethers, ketones, alkanes, terpenes, dibasic esters, glycol ethers, pyrollidones, or low or non ozone depleting chlorinated and chlorinated/fluorinated hydrocarbons. The addition of the fluorinated compounds to the mixture will reduce and/or eliminate the flammability measured as the closed or open cup flash points of the mixture. In addition the proper selection of the materials in the mixture may create an azeotrope or azeotrope-like blend which is desirable. Furthermore, those skilled in the art would be aware of other additives such as surfactants, colorants, dyes, fragrances, indicators,-inhibitors, and buffers as well as other ingredients which modify the properties of the mixture.

The brominated component of the mixture disclosed above contains effective amounts of the brominated material of the form $C_xH_{2x+1}Br$ where x is 2–12, preferably 3 to 8, more preferably 3 to 6. Examples of the suitable brominated materials represented by this formula include, bromoethane, 1-bromopropane, 2-bromopropane, 1-bromobutane, 2-bromobutane, bromomethylpropane, 1-bromopentane, 2-bromopentane, 3-bromopentane, bromomethylbutane, bromocyclopentane, 1-bromohexane, 2-bromohexane, 3-bromohexane, bromomethylpentane, bromoethylbutane, bromocyclohexane, bromoheptane, bromooctane, bromononane, bromodecane and ethylhexyl bromide. They are usable either singly or as a mixture of two or more. Among the most preferred are 1-bromopropane, and 2-bromopropane.

The fluorinated component of the mixture is of the formula $C_aF_bH_cX_d$ where a is 1–16, preferably 2 to 8, more preferably 3 to 7, b>c, c is 1 to 16, preferably 1 to 5, more preferably 1 to 3, d can be 0 or greater and X can be O, N, halogen, or Si, in any possible combination as long as the number of F atoms exceeds the number of H atoms in the molecule, can be used. Examples of suitable fluorinated materials are trifluoromethane, perfluoromethane, tetrafluoroethane, pentafluoroethane, perfluoroethane, pentafluoropropane, hexafluoropropane, heptafluoropropane, perfluoropropane, hexafluorobutane, heptafluorobutane, octafluorobutane, nonafluorobutane, perfluorobutane, heptafluoropentane, octafluoropentane, nonafluoropentane, decafluoropentane, undecafluoropentane, perfluoropentane, octafluorohexane, nonafluorohexane, decafluorohexane, undecafluorohexane, dodecafluorohexane, tridecafluorohexane, and perfluorohexane. Other commercially available fluorinated compounds are: 3-chloro-1,1,1-trifluoropropane (HCFC-253fb); 1,1,1,3,3,5,5,5-octafluoropentane (HFC-458mfcf); 4-trifluoromethyl-1,1,1,2,2,3,3,5,5,5-decafluoropentane (HFC-52-13); 4-trifluoromethyl-1,1,1,2,2,5,5,5-octafluoropentane (HFC-54-11); 4-trifluoromethyl-1,1,1,2,2,3,5,5,5-nonafluoropentane (HFC-53-12); 1,1,1,2,3,4,4,5,5,5-decafluoropentane (HFC-43-10mee); 1,1,1,2,2,3,3,4,4,5,6-undecafluorohexane (HFC-54-11qe); 1,1,2,2,3,3,4,4-octafluorobutane (HFC-338 pcc); 1,1,1,2,2,3,3,4,4-nonafluorobutane-4-methyl ether (HFE-7100); 1,1,1,2,2,3,4,4,4-nonafluoroisobutane-3-methyl ether (HFE-7100); 1,1,1,2,2,3,3,4,4-nonafluorobutane-4-ethyl ether (HFE-7200); 1,1,1,2,2,3,4,4,4-nonafluoroisobutane-3-ethyl ether (HFE-7200); 1,1,2,2,3,3,4,5-octafluorocyclopentane; pentafluoroethane (HFC-134); dichloro-trifluoroethane (HCFC-123); trichloro-tetrafluoropropane (HCFC-224); dichloro-pentafluoropropane (HCFC-225); dichloro-tetrafluoropropane (HCFC-234); chloro-pentafluoropropane (HCFC-235); chloro-tetrafluoropropane (HCFC-244); chloro-hexafluoropropane (HCFC-226); pentachloro-difluoropropane (HCFC-222); tetrachloro-trifluoropropane (HCFC-223); trichloro-trifluoropropane (HCFC-233) pentafluoropropane (HFC-245) and nonafluorobutylethylene (PFBET). They can be used either singly or as a mixture of two or more.

Among the most preferred are HFE-7100, HFC 43-10, HCFC-225, PFBET, HCFC-123, and octafluorocyclopentane.

Other compounds may be added to the mixture to vary the properties of the cleaner or solvent to fit various applications. The addition of these other compounds may also assist in the formation of useful azeotropic compositions. An azeotropic composition is defined as a constant boiling mixture of two or more substances that behaves like a single substance. Azeotropic compositions are desirable because they do not fractionate upon boiling. This behavior is desirable because mixtures may be used in vapor degreasing equipment and or the material may be redistilled.

Since achieving a perfect azeotrope is not practical in industrial use, all mixtures are described as "azeotrope-like". The term "azeotrope-like composition" means a constant boiling, or substantially constant boiling mixture of two or more substances that behave as a single substance, which therefore can distill without substantial compositional change. Constant boiling compositions, which are characterized as "azeotrope-like" will exhibit either a maximum, or minimum boiling point compared to non azeotropic mixtures of two substances.

As used herein, the terms azeotrope, azeotrope-like and constant boiling are intended to mean also essentially azeotropic or essentially constant boiling. In other words, included within the meaning of these terms is not only the true azeotropes, but also other compositions containing the same components in different proportions, which are true azeotropes or are constant boiling at other temperature and pressure. As is well recognized in this art, there is a range of compositions which contain the same components as the azeotrope, which will not exhibit essentially equivalent properties for cleaning, solvating and other applications, but will exhibit essentially equivalent properties as the true azeotropic composition in terms of constant boiling characteristics or tendency not to separate or fractionate on boiling.

The alcohol component of the mixture is of the formula $C_xH_y(OH)_z$ where x is 1 to 12, preferably 1 to 8, more preferably 1 to 6, y<2x+2 and z is 1 or 2. Examples of these alcohols are methyl alcohol, ethyl alcohol, propyl alcohol, isopropyl alcohol, n-butyl alcohol, 2-butyl alcohol, t-butyl alcohol, 1-pentanol, 2-pentanol, 3-pentanol, trifluoroethanol, allyl alcohol, 1-hexanol, 2-hexanol, 3-hexanol, 2-ethyl hexanol, 1-octanol, 1-decanol, 1-dodecanol, cyclohexanol, cyclopentanol, benzyl alcohol, furfuryl alcohol, tetrahydrofurfuryl alcohol, bis-hydroxymethyl tetrahydrofuran, ethylene glycol, propylene glycol, and butylene glycol. They can be used either singly or in the form of a mixture of two or more. Among the most preferred are methanol, ethanol, isopropanol, tert butyl alcohol.

The ester component of the mixture is of the formula $R_1$—COO—$R_2$ where $R_1$ and $R_2$ could be the same or different, $R_1$ is $C_1$–$C_{20}$ alkyl, $C_5$–$C_6$ cycloalkyl, benzyl, furanyl or tetrahydrofuranyl, preferably $C_1$ to $C_8$ alkyl, more preferably $C_1$ to $C_4$ alkyl; $R_2$ is $C_1$–$C_8$ alkyl, preferably $C_1$ to $C_4$ alkyl, $C_5$–$C_6$ cycloalkyl, benzyl, phenyl, furanyl or tetrahydrofuranyl. Examples of these esters are methyl formate, methyl acetate, methyl propionate, methyl butyrate, ethyl formate, ethyl acetate, ethyl propionate, ethyl butyrate, propyl formate, propyl acetate, propyl propionate, propyl butyrate, butyl formate, butyl acetate, butyl propionate, butyl butyrate, methyl soyate, isopropyl myristate, propyl myristate, and butyl myristate. Among the most preferred are methyl formate, methyl acetate, ethyl acetate and ethyl formate.

The ether component of the mixture is of the formula $R_3$—O—$R_4$ where $R_3$ is $C_1$–$C_{10}$ alkyl or alkynl, $C_5$–$C_6$ cycloalkyl, benzyl, phenyl, furanyl or tetrahydrofuranyl, $R_4$ is $C_1$–$C_{10}$ alkyl or alkynyl, $C_5$–$C_6$ cycloalkyl, benzyl, phenyl, furanyl or tetrahydrofuranyl. Examples of these ethers are ethyl ether, methyl ether, propyl ether, isopropyl ether, butyl ether, methyl tert butyl ether, ethyl tert buytl ether, vinyl ether, allyl ether and anisole. In the composition listed $R_3$ and $R_4$, which can be the same or different, can be $C_1$ to $C_{10}$ alkyl or alkynyl, preferably $C_1$ to $C_6$ alkyl or alkynyl, more preferably $C_1$ to $C_4$ alkyl. Among the most preferred are isopropyl ether and propyl ether.

The preferred cyclic ethers for the mixture are: 1,4-dioxane, 1,3-dioxolane tetrahydrofuran (THF), methyl THF, dimethyl THF and tetrahydropyran (THP), methyl THP, dimethyl THP, ethylene oxide, propylene oxide, butylene oxide, amyl oxide, and isoamyl oxide.

The ketone component of the mixture is of the formula: $R_5$—C═O—$R_6$ where $R_5$ is $C_1$–$C_{10}$ alkyl, $C_5$–$C_6$ cycloalkyl, benzyl, furanyl or tetrahydrofuranyl, $R_6$ is $C_1$–$C_{10}$ alkyl, $C_5$–$C_6$ cycloalkyl, benzyl, phenyl, furanyl or tetrahydrofuranyl. Examples of these ketones are acetone, methyl ethyl ketone, 2-pentanone, 3-pentanone, 2-hexanone, 3-hexanone, and methyl isobutyl ketone. In the composition $R_5$ and $R_6$, which can be the same or different, can be $C_1$ to $C_{10}$ alkyl, preferably $C_1$ to $C_6$ alkyl or alkynyl, more preferably $C_1$ to $C_4$ alkyl. Among the most preferred are acetone, methyl ethyl ketone, 3-pentanone and methyl isobutyl ketone.

The alkane component of the mixture is of the formula: $C_nH_{n+2}$ where n is 1–20, or $C_4$–$C_{20}$ cycloalkanes. Examples of these alkanes are methane, ethane, propane, butane, methyl propane, pentane, isopentane, methyl butane, cyclopentane, hexane, cyclohexane, isohexane, heptane, methyl pentane, dimethyl butane, octane, nonane and decane. In the composition, x can be 1 to 20, preferably 4 to 9, more preferably 5 to 7. Among the most preferred are cyclopentane, cyclohexane, hexane, methyl pentane, and dimethyl butane.

The terpene component of the mixture contains at least one isoprene group of the general formula:

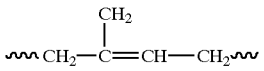

The molecule may be cyclic or multicyclic. Preferred examples are d-limonene, pinene, terpinol, terpentine and dipentene.

The dibasic ester component of the mixture is of the formula: $R_7$—COO—$R_8$—COO—$R_9$ where $R_7$ is $C_1$–$C_{20}$ alkyl, $C_5$–$C_6$ cycloalkyl, benzyl, furanyl or tetrahydrofuranyl, $R_8$ is $C_1$–$C_{20}$ alkyl, $C_5$–$C_5$ cycloalkyl, benzyl, phenyl, furanyl or tetrahydrofuranyl, $R_9$ is $C_1$–$C_{20}$ alkyl, $C_5$–$C_6$ cycloalkyl, benzyl, furanyl or tetrahydrofuranyl. Examples of these dibasic esters are dimethyl oxalate, dimethyl malonate, dimethyl succinate, dimethyl glutarate, dimethyl adipate, methyl ethyl succinate, methyl ethyl adipate, diethyl succinate, diethyl adipate. In the formula, $R_7$, $R_8$, and $R_9$, which can be the same or different, can be $C_1$ to $C_{20}$ alkyl, preferably $C_1$ to $C_6$ alkyl or alkynyl, more preferably $C_1$ to $C_4$ alkyl. Among the most preferred are dimethyl succinate, and dimethyl adipate.

The glycol ether component of the mixture is of the formula: $R_{10}$—O—$R_{11}$—O—$R_{12}$ where $R_{10}$ is $C_2$–$C_{20}$ alkyl, $C_5$–$C_6$ cycloalkyl, benzyl, furanyl or tetrahydrofuranyl, $R_{11}$ is $C_1$–$C_{20}$ alkyl, $C_5$–$C_6$ cycloalkyl, benzyl, phenyl, furanyl or tetrahydrofuranyl, $R_{12}$ is hydrogen or an alcohol as defined above. Examples of these glycol ethers are ethylene glycol methyl ether, diethylene glycol methyl ether, ethylene glycol ethyl ether, diethylene glycol ethyl ether, ethylene glycol propyl ether, diethylene glycol propyl ether, ethylene glycol butyl ether, diethylene glycol butyl ether, propylene glycol methyl ether, dipropylene glycol, dipropylene glycol methyl ether, propylene glycol propyl ether, dipropylene glycol propyl ether, methyl methoxybutanol, propylene glycol butyl ether, and dipropylene glycol butyl ether. $R_{10}$, $R_{11}$, and $R_{12}$, which can be the same or different, can be $C_1$ to $C_{10}$ alkyl, preferably $C_1$ to $C_6$ alkyl, more preferably $C_1$ to $C_4$alkyl. Among the most preferred are propylene glycol butyl ether, dipropylene glycol methyl ether, dipropylene glycol, methyl methoxybutanol, and diethylene glycol butyl ether.

The pyrrolidone component of the mixture is substituted in the N position of the pyrrolidone ring by hydrogen, $C_1$ to $C_6$ alkyl, or $C_1$ to $C_6$ alkanol. Examples of these pyrrolidones are pyrrolidone, N-methyl pyrrolidone, N-ethyl pyrrolidone, N-propyl pyrrolidone, N-hydroxymethyl pyrrolidone, N-hydroxyethyl pyrrolidone, and N-hexyl pyrrolidone. Among the most preferred are N-methyl pyrrolidone and N-ethyl pyrrolidone.

The chlorinated hydrocarbon component is of the formula: $R_{13}$—$Cl_X$ where $R_{13}$ is $C_1$–$C_{20}$ alkyl, $C_4$–$C_{10}$ cycloalkyl, $C_2$–$C_{20}$ alkenyl benzyl, phenyl, fluoroethyl, and X>0, and the Ozone Depletion Potential (ODP) of the molecule<0.15. Examples of these chlorinated materials are methyl chloride, methylene chloride, ethyl chloride, dichloro ethane, dichloro ethylene, propyl chloride, isopropyl chloride, propyl dichloride, butyl chloride, isobutyl chloride, sec-butyl chloride, tert-butyl chloride, pentyl chloride, hexyl chloride, and dichlorofluoro ethane (HCFC-141).

The described mixtures are intended to be used in a similar manner as CFC's and chlorinated solvents, which have been widely used in the past in cleaning applications. These mixtures may be used in various techniques of cleaning which would be apparent to one skilled in the art such as spraying, spray under immersion, vapor degreasing/cleaning, immersion, wiping with cloths and brushes, immersion with ultrasonics, immersion with tumbling and spraying into air. These techniques were used to clean hard surfaces of items and were also used to clean textiles.

The described mixtures are also intended to be used in a similar manner as CFC's and chlorinated solvents, which have been widely used in past solvating applications. These mixtures may be used as a solvent in adhesives, paints, chemical processes, and other applications in which the solubility parameter of the solvent dissolved the solid or liquid, and/or exhibited appropriate volatility for the application.

The key to the success of these mixtures as solvents and cleaning agents is the fact that some of these mixtures may be formulated to have no flash point. This is important because it allows the solvent to be used safely without the threat of flammability as was found in similar solvents which had the same volatility.

DESCRIPTION OF THE PREFERRED EMBODIMENTS

In accordance with the invention, novel compositions have been formulated comprising of one or more brominated hydrocarbons combined with one or more other agents.

The resultant composition can be formulated to have acceptable low ozone depletion potential, and will have some or all of the similar desirable characteristics of CFC's and chlorinated solvents of: cleaning ability, compatibility, volatility, viscosity, solvating ability, drying ability, low or no VOC, and/or surface tension character. In addition some blends will exhibit no flash points in keeping in character with the CFC and chlorinated based solvents.

The content of the enhancement components in the mixture of the present invention is not particularly limited, but for the addition of an effective amount necessary to improve or control solubility, volatility, boiling point, flammability, surface tension, viscosity, reactivity, and material compatibility. Preferably such incorporation of materials will bring about an azeotrope or an azeotrope-like mixture.

As used in this specification and claims, effective amounts for azeotropes is defined as the amount of each component of the inventive compositions that, when combined, results in the formation of an azeotropic or azeotrope-like composition. This definition includes the amounts of each component, which amounts vary depending on the pressure applied to the composition, so long as the azeotropic or azeotrope-like, or constant boiling or substantially constant boiling compositions continue to exist at different pressures, but with possible different boiling points. Therefore, effective amount includes the weight percentage of each component of the composition of the instant invention, which forms azeotropic or azeotrope-like, or constant boiling or substantially constant boiling, compositions at pressures other than atmospheric pressure.

It is possible to characterize, in effect, a constant boiling mixture, which may appear under many guises, depending on the conditions chosen, by any of several criteria:

A composition can be defined as an azeotrope of A, B, and C, since the term "azeotrope" is at once both definitive and limitative, and requires that effective amounts of A, B, and C form this unique composition of matter, which is a constant boiling mixture.

It is well known by those skilled in the art that at different pressures, the composition of a given azeotrope will vary, at least to some degree, and changes in pressure will also change, at least to some degree, the boiling point. Thus an azeotrope of A, B, and C represents a unique type of relationship but with a variable composition which depends on temperature and/or pressure. Therefore compositional ranges rather than fixed compositions are often used to describe azeotropes.

The composition can be defined as a particular weight percent relationship or mole percent relationship of A, B, and C, while recognizing that such specific values point out only one particular such relationship and that in actuality, a series of such relationships, represented by A, B, and C actually exist for a given azeotrope, varied by the influence of pressure.

Azeotrope A, B, and C can be characterized by defining the composition as an azeotrope characterized by a boiling point at a given pressure, thus giving identifying characteristics without unduly limiting the scope of the invention by a specific numerical composition which is limited by and is only as accurate as the analytical equipment available.

The following binary compositions are characterized as azeotropic or azeotrope-like in that compositions within these ranges exhibit substantially constant boiling point at constant pressure. Being substantially constant boiling, the compositions do not tend to fractionate to any great extent upon evaporation at standard conditions. After evaporation, only a small difference exists between the composition of the vapor and the composition of the initial liquid phase. This difference is such that the composition of the vapor and liquid phases are considered substantially the same and are azeotropic or azeotrope like in their behavior.

1) 15–35 weight percent n-propyl bromide (NPB) and 65–85 weight percent nonafluorobutane methyl ether (HFE-7100).
2) 13–33 weight percent NPB and 67–87 weight percent 1,1,1,2,3,4,4,5,5,5-decafluoropentane (HFC-43-10mee).
3) 70–90 weight percent NPB and 10 to 30 weight percent 1,3-dioxolane.
4) 14–34 weight percent NPB and 66–86 weight percent acetone.
5) 75–95 weight percent NPB and 5–25 weight percent isopropyl alcohol.
6) 69–89 weight percent NPB and 11–31 weight percent methanol.
7) 85–99 weight percent NPB and 1–15 weight percent n-propyl alcohol.
8) 74–94 weight percent NPB and 6–26 weight percent t-butyl alcohol.
9) 15–35 weight percent NPB and 65–85 weight percent nonafluorobutylethylene (PFBET).
10) 93–73 weight percent NPB and 7–27 weight percent ethanol.
11) 0.1–10 weight percent 2-bromopropane and 99.9-90 weight percent trifluoro dichloro ethan (HCFC-123).
12) 81–99 weight percent NPB and 1–81 weight percent allyl alcohol.
13) 70–90 weight percent NPB and 10–30 weight percent ethyl acetate.

14) 35–55 weight percent NPB and 45–65 weight percent propyl formate.

15) 84–99.9 weight percent NPB and 0.1–16 weight percent nitromethane.

The following binary compositions have been established, within the accuracy of successive distillation methods, as true binary azeotropes at substantially atmospheric pressure.

1) 25 weight percent NPB and 75 weight percent HFE-7100, boiling point of about 135° F. (about 57° C.).

2) 23 weight percent NPB and 77 weight percent HFC-43-10mee, boiling point of about 126° F. (about 52° C.).

3) 79.5 weight percent NPB and 20.5 weight percent 1,3 dioxolane, boiling point of about 162° F. (about 72° C.).

4) 24 weight percent NPB and 76 weight percent acetone, boiling point of about 134° F. (about 57° C.).

5) 85 weight percent NPB and 15 weight percent isopropyl alcohol, boiling point of about 154° F. (about 68° C.).

6) 79 weight percent NPB and 21 weight percent methanol, boiling point of about 135° F. (about 57° C.).

7) 95 weight percent NPB and 5 weight percent n-propyl alcohol, boiling point of about 158° F. (about 70° C.).

8) 84 weight percent NPB and 16 weight percent t-butyl alcohol boiling point of about 154° F. (about 68° C.).

9) 25 weight percent NPB and 75 weight percent PFBET boiling point of about 131° F. (about 55° C.).

10) 84 weight percent NPB and 16 weight percent ethanol boiling at about 147° F. (about 64° C.).

11) 98 weight percent 2-bromopropane and 2 weight percent HCFC-123 boiling at about 88° F. (about 31° C.).

12) 91 weight percent NPB and 9 weight percent allyl alcohol boiling at about 157° F. (about 69° C.).

13) 80 weight percent NPB and 20 weight percent ethyl acetate boiling at about 159° F. (about 71° C.).

14) 45 weight percent NPB and 55 weight percent propyl formate boiling at about 151° F. (about 66° C.).

15) 94 weight percent NPB and 6 weight percent nitromethane boiling at about 158° F. (about 70° C.).

The following tertiary compositions are characterized as azeotropic or azeotrope-like in that compositions within these ranges exhibit substantially constant boiling point at constant pressure. Being substantially constant boiling, the compositions do not tend to fractionate to any great extent upon evaporation. After evaporation, only a small difference exists between the composition of the vapor and the composition of the initial liquid phase. This difference is such that the composition of the vapor and liquid phases are considered substantially the same and are azeotropic or azeotrope like in their behavior.

1) 18–38 weight percent isopropyl bromide (IPB), 48–68 weight percent nonafluorobutane methyl ether (HFE-7100) and 3–23 weight percent acetone.

2) 10–30 weight percent n-propyl bromide (NPB), 60–80 weight percent nonafluorobutane methyl ether (HFE-7100) and 10–30 weight percent acetone.

3) 17–37 weight percent n-propyl bromide (NPB), 66–86 weight percent nonafluorobutane methyl ether (HFE-7100) and 0.1–14 weight percent methanol.

4) 7–27 weight percent n-propyl bromide (NPB), 56–76 weight percent nonafluorobutane methyl ether (HFE-7100) and 7–27 weight percent methyl acetate.

5) 3–23 weight percent n-propyl bromide (NPB), 69–89 weight percent nonafluorobutane methyl ether (HFE-7100) and 1–17 weight percent tetrahydrofuran.

6) 11–31 weight percent n-propyl bromide (NPB), 65–85 weight percent nonafluorobutane methyl ether (HFE-7100) and 1–14 weight percent isopropyl alcohol.

7) 30–50 weight percent n-propyl bromide (NPB), 34–54 weight percent nonafluorobutane methyl ether (HFE-7100) and 30–50 weight percent cyclopentane.

8) 7–27 weight percent n-propyl bromide (NPB), 66–86 weight percent 1,1,1,2,3,4,4,5,5,5-decafluoropentane (HFC-43-10mee), and 7–27 weight percent methanol.

9) 2–22 weight percent n-propyl bromide (NPB), 77–97 weight percent 1,1,1,2,3,4,4,5,5,5-decafluoropentane (HFC-43-10mee), and 1–12 weight percent isopropanol.

10) x–xx weight percent n-propyl bromide (NPB), XX—XX weight percent nonafluorobutane methyl ether (HFE-7100) and zz to zz weight percent 1-propanol.

11) 9–29 weight percent n-propyl bromide (NPB), 66–86 weight percent nonafluorobutane methyl ether (HFE-7100) and zz0.1–14 weight percent ethanol.

12) 0.1–18 weight percent NPB, 37–57 weight percent nonafluorobutane methyl ether (HFE-7100), and 35–55 weight percent 1,2-trans-dichloroethylene.

13) 25–45 weight percent NPB, 45–65 weight percent 1,1,1,2,3,4,4,5,5,5-decfluoropentane (HFC 43-10mee), and 0.1–20 weight percent acetone.

14) 5–25 weight percent NPB, 69–89 weight percent nonafluorobutylethylene (PFBET), and 0.1–18 weight percent methanol.

The following ternary compositions have been established, within the accuracy of successive distillation methods, as true ternary azeotropes at substantially atmospheric pressure.

1) 28.5 weight percent isopropyl bromide (IPB), 58.0 weight percent nonafluorobutane methyl ether (HFE-7100) and 13.5 weight percent acetone, boiling point of about 124° F. (about 51° C.).

2) 9.5 weight percent n-propyl bromide (NPB), 70.0 weight percent nonafluorobutane methyl ether (HFE-7100) and 20.5 weight percent acetone, boiling point of about 127° F. (about 53° C.).

3) 16.9 weight percent n-propyl bromide (NPB), 75.6 weight percent nonafluorobutane methyl ether (HFE-7100) and 7.5 weight percent methanol, boiling point of about 116° F. (about 47° C.).

4) 16.3 weight percent n-propyl bromide (NPB), 66.4 weight percent nonafluorobutane methyl ether (HFE-7100) and 17.3 weight percent methyl acetate, boiling point of about 130° F. (about 54° C.).

5) 13.0 weight percent n-propyl bromide (NPB), 79.4 weight percent nonafluorobutane methyl ether (HFE-7100) and 7.6 weight percent tetrahydrofuran, boiling point of about 137° F. (about 58° C.).

6) 21.1 weight percent n-propyl bromide (NPB), 75.0 weight percent nonafluorobutane methyl ether (HFE-7100) and 3.9 weight percent isopropyl alcohol, boiling point of about 131° F. (about 55° C.).

7) 39.9 weight percent n-propyl bromide (NPB); 44.6 weight percent nonafluorobutane methyl ether (HFE-7100) and 15.6 weight percent cyclopentane, boiling point of about 110° F. (about 43° C.).

8) 16.5 weight percent n-propyl bromide (NPB), 76.0 weight percent 1,1,1,2,3,4,4,5,5,5-decafluoropentane (HFC-43-10mee), and 7.5 weight percent methanol, boiling point of about 116° F. (about 47° C.).

9) 11.4 weight percent n-propyl bromide (NPB), 87.3 weight percent 1,1,1,2,3,4,4,5,5,5-decafluoropentane (HFC-43-10mee), and 1.3 weight percent isopropanol, boiling point of about 127° F. (about 53° C.).

10) 19.3 weight percent n-propyl bromide (NPB), 76.4 weight percent nonafluorobutane methyl ether (HFE-7100) and 4.3 weight percent 1,3-dioxolane boiling point of about 133° F. (about 56° C.).

11) 20.2 weight percent n-propyl bromide (NPB), 75.5 weight percent nonafluorobutane methyl ether (HFE-7100) and 4.3 weight percent ethanol, boiling point of about 122° F. (about 50° C.).

12) 8 weight percent NPB, 47 weight percent nonafluorobutane methyl ether (HFE-7100), and 45 weight percent 1,2-trans-dichloroethylene, boiling at about 116° F. (about 47° C.).

13) 35 weight percent NPB, 55 weight percent 1,1,1,2,3,4,4,5,5,5-decafluoropropane (HFC 43-10mee), and 10 weight percent acetone boiling at about 128° F. (about 53° C.).

14) 15 weight percent NPB, 79 weight percent monofluorobutylethylene (PFBET), and 8 weight percent methanol boiling at about 113° F. (about 45° C.).

It is Preferred that inhibitors be added to the compositions to inhibit decomposition, react with undesirable decomposition products of the compositions, and/or prevent corrosion of metal surfaces. Any and all of the following classes of inhibitors may be employed in the invention, some of which may serve a dual purpose as suitable components for cleaning and solvating. Preferred are alkanols having 4 to 7 carbon atoms, nitroalkanes having 1 to 3 carbon atoms, 1,2 epoxyalkanes having 2 to 7 carbon atoms, acetylene alcohols having 3 to 9 carbon atoms, phosphite esters having 12 to 30 carbon atoms, ethers having 3 to 6 carbon atoms, unsaturated hydrocarbon compounds having 4 to 7 carbon atoms, triazoles, acetals having 4 to 7 carbon atoms, ketones having 3 to 5 carbon atoms, and amines having 6 to 8 carbon atoms. Other suitable inhibitors will be readily apparent to those skilled in the art.

Inhibitors may be used alone or in mixtures in any proportions. Typically less than 5 weight percent and, preferably, less than 2 weight percent of inhibitor based on the total weight of the mixture may be used.

In addition the composition of the present invention may further contain surfactants, emulsifying agents, wetting agents, water, perfumes, indicators, or colorants.

The compositions of the invention are useful for solvating, vapor degreasing, photoresist stripping, adhesive removal, aerosol, cold cleaning, and solvent cleaning applications including defluxing, dry cleaning, degreasing, particle removal, metal and textile cleaning.

EXAMPLES 1–28

The azeotropic mixtures of this invention were initially identified by screening mixtures of monobrominated hydrocarbons and various organic solvents including the fluorinated solvents mentioned earlier. The selected mixtures were distilled in a Kontes multistage distillation apparatus using a Snyder distillation column. The distilled overhead composition was analyzed using a Hewlett-Packard Gas Chromatograph using a FID detector and a HP-4 column. The overhead composition was compared to the feed composition to identify the azeotropic composition. If the feed and overhead compositions differed then the overhead material was collected and re-distilled until successive distillation compositions were within 1% of the feed composition, indicating an azeotrope. The method was also supplemented by recording temperatures of the feed at boiling. The presence of an azeotrope was also indicated when the test mixture exhibited a lower boiling point than the boiling point of the subsequent feed mixture. Results obtained are summarized in Table 1.

TABLE 1

Azeotrope Compositions

| Example | Monobrominated Material | Fluorinated Material | Other Material | Weight Percent Mono-brominated | Weight Percent Fluorinated | Weight Percent Other Material | Azeotrope Boiling Point ° F./° C. | Flash Point |
|---|---|---|---|---|---|---|---|---|
| 1 | 1-Bromopropane | HFE-7100 | | 25.0% | 75.0% | | 135/57 | None |
| 2 | 1-Bromopropane | HFC-4310 | | 23.0% | 77.0% | | 126/52 | None |
| 3 | 1-Bromopropane | PFBET | | 25.0% | 75.0% | | 131/55 | None |
| 4 | 1-Bromopropane | | 1-Propanol | 95.0% | | 5.0% | 158/70 | Yes |
| 5 | 1-Bromopropane | | 2-Propanol | 85.2% | | 14.8% | 154/68 | Yes |
| 6 | 1-Bromopropane | | Methanol | 79.0% | | 21.0% | 135/57 | Yes |
| 7 | 1-Bromopropane | | Ethanol | 83.8% | | 16.2% | 147/64 | Yes |
| 8 | 1-Bromopropane | | t-Butanol | 84.0% | | 16.0% | 158/70 | Yes |
| 9 | 1-Bromopropane | | Acetone | 24.0% | | 76.0% | 128/53 | Yes |
| 10 | 1-Bromopropane | | 1,3-Dioxolane | 79.5% | | 20.5% | 134 | Yes |
| 11 | 2-Bromopropane | CHFC-123 | | 98.2% | | 88.0% | None | Yes |
| 12 | 1-Bromopropane | HFE-7100 | Acetone | 9.5% | 70.0% | 20.5% | 127/53 | Yes |
| 13 | 1-Bromopropane | | Allyl alcohol | 91.0 | | 9.0 | 157/69 | Yes |
| 14 | 1-Bromopropane | | Ethyl acetate | 80.0 | | 20.0 | 159/71 | Yes |
| 15 | 1-Bromopropane | | Propyl formate | 45.0 | | 55.0 | 151/66 | Yes |
| 16 | 1-Bromopropane | | Nitromethane | 94.0 | | 4.0 | 158/70 | Yes |
| 17 | 1-Bromopropane | HFC-4310 | Acetone | 35.0 | 55.0 | 10.0 | 128/53 | Yes |
| 18 | 1-Bromopropane | PFBET | Methanol | 15.0 | 77.0 | 8.0 | 113/45 | Yes |
| 19 | 2-Bromopropane | HFE-7100 | Acetone | 28.5% | 58.0% | 13.5% | 124/51 | Yes |
| 20 | 1-Bromopropane | HFE-7100 | Methanol | 16.9% | 75.6% | 7.5% | 116/47 | None |

TABLE 1-continued

Azeotrope Compositions

| Example | Monobrominated Material | Fluorinated Material | Other Material | Weight Percent Mono-brominated | Weight Percent Fluorinated | Weight Percent Other Material | Azeotrope Boiling Point ° F./° C. | Flash Point |
|---|---|---|---|---|---|---|---|---|
| 21 | 1-Bromopropane | HFE-7100 | Ethanol | 20.2% | 75.5% | 4.3% | 122/50 | No |
| 22 | 1-Bromopropane | HFE-7100 | Cyclopentane | 39.9% | 44.6% | 15.6% | 110/43 | Yes |
| 23 | 1-Bromopropane | HFE-7100 | 2-Propanol | 21.1% | 75.0% | 3.9% | 131/55 | None |
| 24 | 1-Bromopropane | HFE-7100 | Methyl Acetate | 16.3% | 66.4% | 17.3% | 130/54 | Yes |
| 25 | 1-Bromopropane | HFE-7100 | Tetrahydrofuran | 13.0% | 79.4% | 7.6% | 137/58 | Yes |
| 26 | 1-Bromopropane | HFE-7100 | 1,3 Dioxolane | 19.3% | 76.4% | 4.3% | 133/56 | Yes |
| 27 | 1-Bromopropane | HFC-4310 | Methanol | 16.5% | 76.0% | 7.5% | 116/47 | Yes |
| 28 | 1-Bromopropane | HFC-4310 | 2-Propanol | 11.4% | 87.3% | 1.3% | 127/53 | Yes |

EXAMPLES 29–48

Cleaning/solvating compositions given in Table 2 were prepared using binary mixture of selected brominated compounds and selected fluorinated compounds at various compositions. Tests were conducted to determine the cleaning and solvating of the solvent compositions on the following soils and contaminants materials:

Machine oil from a steel coupon

Axle grease from an aluminum coupon

Lipstick on glass coupon

Adhesive on glass coupon

Epoxy Paint on glass coupon

| | |
|---|---|
| 5 | 100% clean |
| 4 | 90–99% clean |
| 3 | 75–89% clean |
| 2 | 50–74% clean |
| 1 | <50% clean |

Below in Table 2 are the results of the cleaning test of mixtures of brominated and fluorinated materials

TABLE 2

Binary Compositions - Cleaning

| Example | Monobrominated Material | Fluorinated Material | Percent Mono-brominated | Percent Fluorinated | Flash Point Open Cup | Oil on Steel | Grease | Lipstick | Adhesive | Epoxy Paint | Latex Paint | Beeswax | Alpha 615 RMA Flux | Kester 244 No Clean Flux |
|---|---|---|---|---|---|---|---|---|---|---|---|---|---|---|
| 29 | 1-Bromopropane | HFE-7100 | 80% | 20% | None to Boil | 5 | 5 | 3 | 5 | 3 | 2 | 3 | 5 | 5 |
| 30 | 1-Bromopropane | HFC-4310 | 80% | 20% | None to Boil | 5 | 5 | 5 | 5 | 4 | 2 | 2 | 5 | 5 |
| 31 | 2-Bromopropane | HFE-7100 | 80% | 20% | None to Boil | 5 | 5 | 3 | 4 | 1 | 2 | 1 | 5 | 4 |
| 32 | 2-Bromopropane | HFC-4310 | 80% | 20% | None to Boil | 5 | 5 | 3 | 4 | 1 | 2 | 1 | 5 | 4 |
| 33 | 1-Bromopropane | HCFC-225 | 80% | 20% | None to Boil | 5 | 5 | 2 | 5 | 2 | 2 | 1 | 5 | 5 |
| 34 | 1-Bromopropane | PFBET | 80% | 20% | None to Boil | 5 | 4 | 5 | 4 | 4 | 2 | 1 | 4 | 5 |
| 35 | 2-Bromopropane | PFBET | 80% | 20% | None to Boil | 5 | 3 | 5 | 4 | 1 | 2 | 1 | 2 | 3 |
| 36 | 1-Bromobutane | HFE-7100 | 80% | 20% | None to Boil | 5 | 3 | 3 | 4 | 2 | 2 | 2 | 5 | 5 |
| 37 | 2-Bromobutane | HFE-7100 | 80% | 20% | None to Boil | 5 | 5 | 3 | 5 | 3 | 2 | 3 | 5 | 5 |
| 38 | 1-Bromopentane | HFE-7100 | 80% | 20% | None to Boil | 5 | 4 | 3 | 2 | 2 | 2 | 2 | 5 | 3 |
| 39 | 2-Bromopentane | HFE-7100 | 80% | 20% | None to Boil | 5 | 4 | 2 | 2 | 2 | 2 | 2 | 5 | 3 |
| 40 | 1-Bromopropane | HCFC-225 | 20% | 80% | None to Boil | 5 | 5 | 1 | 5 | 1 | 2 | 1 | 5 | 1 |
| 41 | 1-Bromopropane | HFE-7100 | 20% | 80% | None to Boil | 4 | 1 | 1 | 1 | 1 | 1 | 1 | 2 | 1 |
| 42 | 1-Bromopropane | HFC-4310 | 20% | 80% | None to Boil | 3 | 3 | 2 | 2 | 1 | 3 | 1 | 2 | 2 |
| 43 | 2-Bromopropane | HFE-7100 | 20% | 80% | None to Boil | 4 | 1 | 1 | 1 | 1 | 1 | 1 | 1 | 1 |
| 44 | 2-Bromopropane | HFC-4310 | 20% | 80% | None to Boil | 3 | 2 | 1 | 2 | 1 | 2 | 1 | 2 | 2 |
| 45 | 1-Bromobutane | HFE-7100 | 20% | 80% | None to Boil | 4 | 1 | 1 | 1 | 1 | 1 | 1 | 2 | 2 |
| 46 | 2-Bromobutane | HFE-7100 | 20% | 80% | None to Boil | 4 | 2 | 1 | 2 | 2 | 1 | 1 | 2 | 2 |
| 47 | 1-Bromopentane | HFE-7100 | 20% | 80% | None to Boil | 4 | 1 | 1 | 1 | 1 | 2 | 1 | 1 | 2 |
| 48 | 2-Bromopentane | HFE-7100 | 20% | 80% | None to Boil | 4 | 1 | 1 | 1 | 1 | 2 | 1 | 1 | 2 |

Latex Paint on glass coupon

Beeswax on steel coupon

Rosin Flux type RA Alpha 615 on ceramic circuit

No Clean Flux Kester 244 on ceramic circuit

The substrate (coupon) was prepared a minimum of 1 day in advance of the cleaning test. The samples were immersed in an unagitiated beaker at room-temperature for 3 minutes, then they were removed, allowed to air dry and inspected for any remaining soil residue. The cleaning test was judged on a 1 to 5 scale as follows:

EXAMPLES 49–80

Cleaning/solvating compositions given in Table 3 were prepared using ternary mixtures of selected brominated compounds, selected fluorinated compounds and selected third components disclosed above at various compositions. Tests were conducted to determine the cleaning and solvating of the solvent mixtures using the same method as previously discussed. The cleaning test was judged on a 1 to 5 scale as follows:

TABLE 3

Ternary Compositions - Cleaning

| Example | Monobrominated Material | Fluorinated Material | Other Material | Percent Mono-brominated | Percent Fluorinated | Percent Other Material | Oil on Steel | Grease | Lipstick | Adhesive | Epoxy Paint | Latex Paint | Bees wax | Alpha 615 RMA Flux | Kester 244 No Clean Flux |
|---|---|---|---|---|---|---|---|---|---|---|---|---|---|---|---|
| 49 | 1-Bromopropane | HFE-7100 | Methanol | 75% | 20% | 5% | 5 | 5 | 5 | 4 | 4 | 3 | 3 | 5 | 5 |
| 50 | 2-Bromopropane | HFE-7100 | Methanol | 75% | 20% | 5% | 5 | 5 | 5 | 5 | 5 | 2 | 4 | 5 | 5 |
| 51 | 1-Bromobutane | HFE-7100 | Methanol | 75% | 20% | 5% | 5 | 5 | 4 | 5 | 2 | 2 | 4 | 5 | 5 |
| 52 | 2-Bromobutane | HFE-7100 | Methanol | 75% | 20% | 5% | 5 | 4 | 2 | 5 | 2 | 2 | 3 | 5 | 5 |
| 53 | 1-Bromopentane | HFE-7100 | Methanol | 75% | 20% | 5% | 5 | 4 | 5 | 5 | 2 | 2 | 3 | 5 | 5 |
| 54 | 2-Bromopentane | HFE-7100 | Methanol | 75% | 20% | 5% | 5 | 5 | 5 | 5 | 2 | 2 | 3 | 5 | 5 |
| 55 | 1-Bromopropane | HFE-7100 | 1-Propanol | 75% | 20% | 5% | 5 | 5 | 4 | 5 | 2 | 2 | 2 | 5 | 5 |
| 56 | 1-Bromopropane | HFE-7100 | 2-Propanol | 75% | 20% | 5% | 5 | 5 | 3 | 5 | 3 | 2 | 2 | 5 | 5 |
| 57 | 1-Bromopropane | HFE-7100 | Cyclohexanol | 75% | 20% | 5% | 5 | 5 | 5 | 5 | 3 | 2 | 2 | 5 | 5 |
| 58 | 1-Bromopropane | HFE-7100 | Tetrahydrofurfuryl Alcohol | 75% | 20% | 5% | 5 | 5 | 3 | 5 | 2 | 2 | 2 | 5 | 5 |
| 59 | 1-Bromopropane | HFE-7100 | Cyclohexane | 75% | 20% | 5% | 5 | 1 | 5 | 5 | 5 | 1 | 2 | 5 | 1 |
| 60 | 1-Bromopropane | HFE-7100 | Heptane | 75% | 20% | 5% | 5 | 5 | 5 | 4 | 2 | 2 | 2 | 5 | 4 |
| 61 | 1-Bromopropane | HFE-7100 | d-Limonene | 75% | 20% | 5% | 5 | 3 | 4 | 5 | 1 | 2 | 2 | 5 | 4 |
| 62 | 1-Bromopropane | HFE-7100 | Methylene Chloride | 75% | 20% | 5% | 5 | 5 | 5 | 5 | 2 | 3 | 3 | 5 | 3 |
| 63 | 1-Bromopropane | HFE-7100 | Methyl Acetate | 75% | 20% | 5% | 5 | 5 | 5 | 5 | 3 | 3 | 4 | 5 | 5 |
| 64 | 1-Bromopropane | HFE-7100 | Methyl Formate | 75% | 20% | 5% | 5 | 5 | 5 | 5 | 1 | 2 | 2 | 5 | 3 |
| 65 | 1-Bromopropane | HFE-7100 | HCFC-225 | 75% | 20% | 5% | 5 | 5 | 5 | 5 | 1 | 2 | 2 | 5 | 4 |
| 66 | 1-Bromopropane | HFE-7100 | 1,2-Transdichloroethylene | 75% | 20% | 5% | 5 | 5 | 5 | 5 | 1 | 3 | 3 | 5 | 4 |
| 67 | 1-Bromopropane | HFE-7100 | Tetrahydrofuran | 75% | 20% | 5% | 5 | 5 | 5 | 5 | 2 | 2 | 2 | 5 | 5 |
| 68 | 1-Bromopropane | HFE-7100 | 1,3 Dioxolane | 75% | 20% | 5% | 5 | 3 | 5 | 5 | 1 | 2 | 2 | 5 | 2 |
| 69 | 1-Bromopropane | HFE-7100 | Dipropylene Glycol | 75% | 20% | 5% | 5 | 5 | 4 | 5 | 2 | 4 | 3 | 5 | 5 |
| 70 | 1-Bromopropane | HFE-7100 | Propylene Glycol Butyl Ether | 75% | 20% | 5% | 5 | 4 | 5 | 5 | 2 | 4 | 1 | 5 | 5 |
| 71 | 1-Bromopropane | HFE-7100 | Dipropylene Glycol Methyl Ether | 75% | 20% | 5% | 5 | 5 | 5 | 5 | 3 | 3 | 3 | 5 | 3 |
| 72 | 1-Bromopropane | HFE-7100 | Diethylene Glycol Butyl Ether | 75% | 20% | 5% | 5 | 5 | 2 | 5 | 3 | 3 | 3 | 5 | 3 |
| 73 | 1-Bromopropane | HFE-7100 | Dipropylene Glycol Methyl Ether Acetate | 75% | 20% | 5% | 5 | 5 | 5 | 3 | 2 | 2 | 2 | 5 | 5 |
| 74 | 1-Bromopropane | HFE-7100 | Mixed (C4–C6) Dibasic Esters | 75% | 20% | 5% | 5 | 4 | 3 | 5 | 1 | 2 | 2 | 5 | 5 |
| 75 | 1-Bromopropane | HFE-7100 | n-Methyl Pyrrolidone | 75% | 20% | 5% | 5 | 4 | 5 | 5 | 2 | 2 | 2 | 5 | 5 |
| 76 | 1-Bromopropane | HFE-7100 | n-Ethyl Pyrrolidone | 75% | 20% | 5% | 5 | 5 | 5 | 5 | 2 | 2 | 2 | 5 | 5 |
| 77 | 1-Bromopropane | HFE-7100 | Methyl Soyate | 75% | 20% | 5% | 5 | 5 | 5 | 5 | 2 | 2 | 2 | 5 | 5 |
| 78 | 1-Bromopropane | HFE-7100 | Isopropyl Ether | 75% | 20% | 5% | 5 | 5 | 5 | 5 | 1 | 3 | 1 | 5 | 5 |
| 79 | 1-Bromopropane | HFE-7100 | Methyl Ethyl Ketone | 75% | 20% | 5% | 5 | 4 | 3 | 5 | 1 | 2 | 2 | 5 | 5 |
| 80 | 1-Bromopropane | HFE-7100 | Acetone | 75% | 20% | 5% | 5 | 4 | 4 | 5 | 4 | 2 | 2 | 5 | 5 |

EXAMPLES 81–89

Cleaning/solvating compositions given in Table 4 were prepared using binary azeotrope mixtures of selected brominated compounds, and selected fluorinated and or other compounds at the azeotrope composition. Tests were conducted to determine the cleaning and solvating of the solvent mixtures using the same method as previously discussed. The cleaning test was judged on a 1 to 5 scale as follows:

TABLE 4

Binary Azeotrope Compositions - Cleaning

| Example | Monobrominated Material | Other Material | Percent Monobrominated | Percent Other | Oil on Steel | Grease | Lipstick | Adhesive | Epoxy Paint | Latex Paint | Bees wax | Alpha 615 RMA Flux | Kester 244 No Clean Flux | Open Cup Flash Point |
|---|---|---|---|---|---|---|---|---|---|---|---|---|---|---|
| 81 | 1-Bromopropane | HFE-7100 | 25% | 75% | 5 | 2 | 1 | 1 | 1 | 1 | 1 | 3 | 2 | None |
| 82 | 1-Bromopropane | HFC-4310 | 23% | 77% | 3 | 2 | 1 | 2 | 1 | 3 | 1 | 2 | 2 | None |
| 83 | 1-Bromopropane | PFBET | 23% | 77% | 4 | 1 | 1 | 1 | 1 | 1 | 1 | 2 | 1 | None |
| 84 | 1-Bromopropane | 1-Propanol | 95% | 5% | 5 | 5 | 5 | 5 | 5 | 3 | 1 | 5 | 5 | Yes |
| 85 | 1-Bromopropane | 2-Propanol | 85% | 15% | 5 | 4 | 5 | 5 | 2 | 3 | 3 | 5 | 5 | Yes |
| 86 | 1-Bromopropane | Methanol | 79% | 21% | 5 | 4 | 3 | 5 | 3 | 3 | 1 | 5 | 5 | Yes |
| 87 | 1-Bromopropane | Ethanol | 84% | 16% | 5 | 5 | 5 | 5 | 5 | 3 | 1 | 5 | 5 | Yes |
| 88 | 1-Bromopropane | t-Butanol | 84% | 16% | 5 | 5 | 5 | 5 | 4 | 3 | 1 | 5 | 5 | Yes |
| 89 | 1-Bromopropane | Acetone | 24% | 76% | 5 | 2 | 1 | 4 | 2 | 2 | 2 | 5 | 5 | Yes |

EXAMPLES 90–101

Cleaning/solvating compositions given in Table 5 were prepared using ternary azeotropic mixtures of selected brominated compounds, selected fluorinated compounds and selected third components at the disclosed azeotropic composition. Tests were conducted to determine the cleaning and solvating of the solvent mixtures using the same method as previously discussed. The cleaning test was judged on a 1 to 5 scale as follows:

TABLE 5

Ternary Azeotrope Compositions - Cleaning

| Example | Monobrominated Material | Fluorinated Material | Other Material | Percent Monobrominated | Percent Fluorinated | Percent Other Material | Oil on Steel | Grease | Lipstick | Adhesive | Epoxy Paint | Latex Paint | Bees wax | Alpha 615 RMA Flux | Kester 244 No Clean Flux | Open Cup Flash Point |
|---|---|---|---|---|---|---|---|---|---|---|---|---|---|---|---|---|
| 90 | 1-Bromopropane | HFE-7100 | Acetone | 9.5% | 70.0% | 20.5% | 5 | 2 | 1 | 1 | 1 | 1 | 1 | 3 | 2 | Yes |
| 91 | 2-Bromopropane | HFE-7100 | Acetone | 28.5% | 58.0% | 13.5% | 3 | 2 | 1 | 2 | 1 | 3 | 1 | 2 | 2 | Yes |
| 92 | 1-Bromopropane | HFE-7100 | Methanol | 16.9% | 75.6% | 7.5% | 2 | 1 | 1 | 1 | 1 | 1 | 1 | 5 | 1 | Yes |
| 93 | 1-Bromopropane | HFE-7100 | Ethanol | 20.2% | 75.5% | 4.3% | | | | | | | | | | None |
| 94 | 1-Bromopropane | HFE-7100 | 2-Propanol | 21.1% | 75.0% | 3.9% | 4 | 1 | 1 | 1 | 1 | 1 | 1 | 3 | 1 | Yes |
| 95 | 1-Bromopropane | HFE-7100 | Methyl Acetate | 16.3% | 66.4% | 17.3% | 2 | 2 | 1 | 1 | 1 | 1 | 1 | 1 | 1 | Yes |
| 96 | 1-Bromopropane | HFE-7100 | Tetrahydrofuran | 13.0% | 79.4% | 7.6% | 4 | 1 | 1 | 1 | 1 | 1 | 1 | 2 | 1 | None |
| 97 | 1-Bromopropane | HFE-7100 | 1,3 Dioxolane | 19.3% | 76.4% | 4.3% | 4 | 1 | 1 | 1 | 1 | 1 | 1 | 2 | 2 | None |
| 98 | 1-Bromopropane | HFC-4310 | Methanol | 16.5% | 76.0% | 7.5% | 2 | 1 | 1 | 1 | 1 | 1 | 1 | 3 | 1 | None |
| 99 | 1-Bromopropane | HFC-4310 | 2-Propanol | 11.4% | 87.3% | 1.3% | 3 | 1 | 1 | 1 | 1 | 1 | 1 | 1 | 1 | None |
| 100 | 1-Bromopropane | HFE-7100 | Ethanol | 20.2% | 75.5% | 4.3% | 4 | 1 | 1 | 1 | 1 | 1 | 1 | 3 | 1 | |
| 101 | 1-Bromopropane | HFE-7100 | 1,2-trans-dichloroethylene | 8.0% | 47.0% | 45.0% | 5 | 2 | 1 | 1 | 1 | 1 | 1 | 4 | 5 | |

It should be apparent from the foregoing detailed description that the objects set forth at the outset to the specification have been successfully achieved. Moreover, while there is shown and described present preferred embodiments of the invention, it is to be distinctly understood that the invention is not limited thereto but may be otherwise variously embodied and practiced within the scope of the following claims.

What is claimed:

1. A composition for use as a solvent and cleaner comprising:

(A) about 5–37 weight percent n-propyl bromide (NPB);

(B) about 65–89 weight percent nonafluorobutane methyl ether (HFE-7100), nonafluorobutylethylene (PFBET), or 1,1,1,2,3,4,4,5,5,5-decafluoropentane (HFC-43-10mee); and (C) about 0.1–18 is weight percent of an alcohol.

2. A composition as defined in claim 1, wherein said alcohol is an alcohol of the formula $C_rH_s(OH)_t$ where r is 1 to 18, s <2x+2 and t is 1 or 2.

3. A composition as defined in claim 2, wherein said alcohol is selected from the group consisting of methyl alcohol, ethyl alcohol, n-propyl alcohol, isopropyl alcohol, n-butyl alcohol, 2-butyl alcohol, t-butyl alcohol, 1-pentanol, 2-pentanol, 3-pentanol, trifluoroethanol, allyl alcohol, 1-hexanol, 2-hexanol, 8-hexanol, 2-ethyl hexanol, 1-octanol, 1-decanol, 1-dodecanol, cyclohexanol, cyclopentanol, benzyl alcohol, furfuryl alcohol, tetrahydrofuxfuryl alcohol, bis-hydroxymetbyl tetrahydrofunn, ethylene glycol, propylene glycol, butylene glycol, and mixtures thereof.

4. A composition as defined in claim 3, wherein said alcohol is selected from the group consisting of methanol, ethanol, isopropanol, t-butyl alcohol, and mixtures thereof.

5. An azeotropic or azeotrope-like composition as defined in claim 1, comprising about 17–37 weight percent NPB, about 66–86 weight percent HFE-7100 and about 0.1–14 weight percent methanol.

6. An azeotropic or azeotrope-like composition as defined in claim 5, comprising about 16.9 weight percent NPB, about 75.6 weight percent HFE-7100 and about 7.5 weight percent methanol, having a boiling point of about 116° F. (about 47° C.) at 1 atmosphere pressure.

7. An azeotropic or azeotrope-like composition as defined in claim 1, comprising about 11–31 weight percent NPB, about 65–85 weight percent HFE-7100 and about 1–14 weight percent isopropyl alcohol.

8. An azeotropic or azeotrope-like composition as defined in claim 7, comprising about 21.1 weight percent NPB, about 75.0 weight percent HFE-7100 and about 3.9 weight percent isopropyl alcohol, having a boiling point of about 131° F. (about 55° C.) at 1 atmosphere pressure.

9. An azeotropic or azeotrope-like composition as defined in claim 1, comprising about 7–27 weight percent NPB, about 66–86 weight percent HFC-43-10mee and about 7–27 weight percent methanol.

10. An azeotropic or azeotrope-like composition as defined in claim 9, comprising about 16.5 weight percent NPB, about 76.0 weight percent HFC-43-10mee, and about 7.5 weight percent methanol, having a boiling point of about 116° F., (about 47° C.) at 1 atmosphere pressure.

11. An azeotropic or azeotrope-like composition as defined in claim 1,$Somprising about 10–30 weight percent NPB, about 66–86 weight percent HFE-7100 and about 0.1–14 weight percent ethanol.

12. An azeotropic or azeotrope-like composition as defined in claim 11, comprising about 20.2 weight percent NPB, 75.5 weight HFE-7100 and 4.3 weight percent ethanol, having a boiling point of about 122° F. (about 50° C.) at 1 atmosphere pressure.

13. An azeotropic or azeotrope-like composition as defined in claim 1, comprising about 5–25 weight percent NPB, 69–89 weight percent PFBET, and 0.1–18 weight percent methanol.

14. An azeotropic or azeotrope-like composition as defined in claim 13, comprising about 15 weight percent NPB, 79 weight percent PPBET, and 8 weight percent methanol, having a boiling point of about 113° C. (about 45° C.) at 1 atmosphere pressure.

* * * * *